US007726049B2

(12) United States Patent
Hill, III et al.

(10) Patent No.: US 7,726,049 B2
(45) Date of Patent: Jun. 1, 2010

(54) SQUEEGEE BLADE

(75) Inventors: Giles A. Hill, III, P.O. Box 809, Idabel, OK (US) 74745; Duane S. Birdsong, Idabel, OK (US)

(73) Assignee: Giles A. Hill, III, Idabel, OK (US)

( * ) Notice: Subject to any disclaimer, the term of this patent is extended or adjusted under 35 U.S.C. 154(b) by 0 days.

(21) Appl. No.: 11/710,774

(22) Filed: Feb. 26, 2007

(65) Prior Publication Data

US 2007/0144041 A1 Jun. 28, 2007

Related U.S. Application Data

(63) Continuation of application No. 10/838,102, filed on May 3, 2004, now Pat. No. 7,198,687.

(60) Provisional application No. 60/467,438, filed on May 1, 2003.

(51) Int. Cl.
*E01H 5/06* (2006.01)

(52) U.S. Cl. ..... 37/233; 37/266; 15/245

(58) Field of Classification Search ..... 37/232, 37/233, 266, 449; 15/245
See application file for complete search history.

(56) References Cited

U.S. PATENT DOCUMENTS

| | | | | | |
|---|---|---|---|---|---|
| 4,620,815 | A * | 11/1986 | Goetter | 411/84 |
| 5,012,599 | A * | 5/1991 | DeClair et al. | 37/444 |
| 5,452,929 | A * | 9/1995 | Anderson | 292/288 |
| 5,471,770 | A * | 12/1995 | Ferreira | 37/264 |
| 5,611,157 | A * | 3/1997 | Ferreira | 37/449 |
| 5,741,112 | A * | 4/1998 | Lakin et al. | 414/722 |
| 6,612,050 | B2 * | 9/2003 | Takeuchi | 37/232 |
| 6,922,924 | B2 * | 8/2005 | Jones et al. | 37/449 |
| 7,107,709 | B2 * | 9/2006 | Hamel | 37/232 |
| 7,198,687 | B2 * | 4/2007 | Hill et al. | 156/130.5 |

* cited by examiner

*Primary Examiner*—Gary S Hartmann
(74) *Attorney, Agent, or Firm*—Osha • Liang LLP; John W. Montgomery

(57) ABSTRACT

A squeegee blade includes a mounting plate with a surface. A relatively rigid support member is attached to the surface of the mounting plate and a relatively flexible blade is attached to the surface of the mounting plate adjacent to the support member so that the blade is supported by the support member against compression toward the mounting plate.

17 Claims, 5 Drawing Sheets

*FIG. 1*

SQUEEGEE BLADE

CROSS-REFERENCE TO RELATED APPLICATIONS

This is an application, which is a continuation of and claims priority to U.S. application Ser. No. 10/838,102 filed on May 3, 2004 that claimed priority to U.S. Provisional Application No. 60/467,438 filed on May 1, 2003.

BACKGROUND OF INVENTION

1. Field of the Invention

The invention relates generally to squeegee blades for use on construction equipment.

2. Background Art

Rubber cutting edge blades have been made with a rubber portion adhered to a mounting plate that is bolted to the existing blade of a front end loader, dozer or other construction equipment. These blades are typically bolted by the mounting plate to the bucket of a front end loader, a shovel blade, caterpillar blade, bull dozer blade or other material moving blade of and industrial tractor, construction equipment or other heavy equipment. Such attached rubber edged blades are particularly useful in warehouses and other floored industrial environments to scrape or squeegee loose materials or liquid from the floor. When in use, the heavy equipment can place large downward forces on the rubber of the blade with hydraulic blade actuation while moving the blade and causing it to scrape along the floor or ground surface with the powerful motivating force of the heavy equipment. Rapid abrasion and wear have been noted.

SUMMARY OF INVENTION

One aspect of the invention provides a squeegee blade that includes a relatively rigid mounting surface, at least one relatively rigid support secured to the mounting surface, and a relatively flexible blade secured to the mounting surface and positioned adjacent to the at least one relatively rigid support, so that the relatively rigid support acts to support the flexible blade against compression toward the relatively rigid mounting surface.

Another aspect of the invention provides a mounting mechanism for a squeegee blade including an elongated slot having a narrow channel with a first end in one direction and a second end in an opposite direction, the narrow channels sized for receiving the shaft of fasteners therethrough and for holding against the head of the fasteners and having a wide portion positioned toward the first end of the narrow channel and sized for receiving the head of the fasteners therethrough and at least one keyhole shaped hole having a short narrow channel, the short narrow channel extending a short distance along the mounting plate, and having a wide portion in the one direction and the short narrow channel portion at another end portion, the narrow channels sized for receiving the shaft of the fasteners therethrough and for holding against the head of the fasteners and the wide portion sized for receiving the head of the fasteners therethrough.

Other aspects and advantages of the invention will be apparent from the following description and the appended claims.

DETAILED DESCRIPTION

Figure 1:
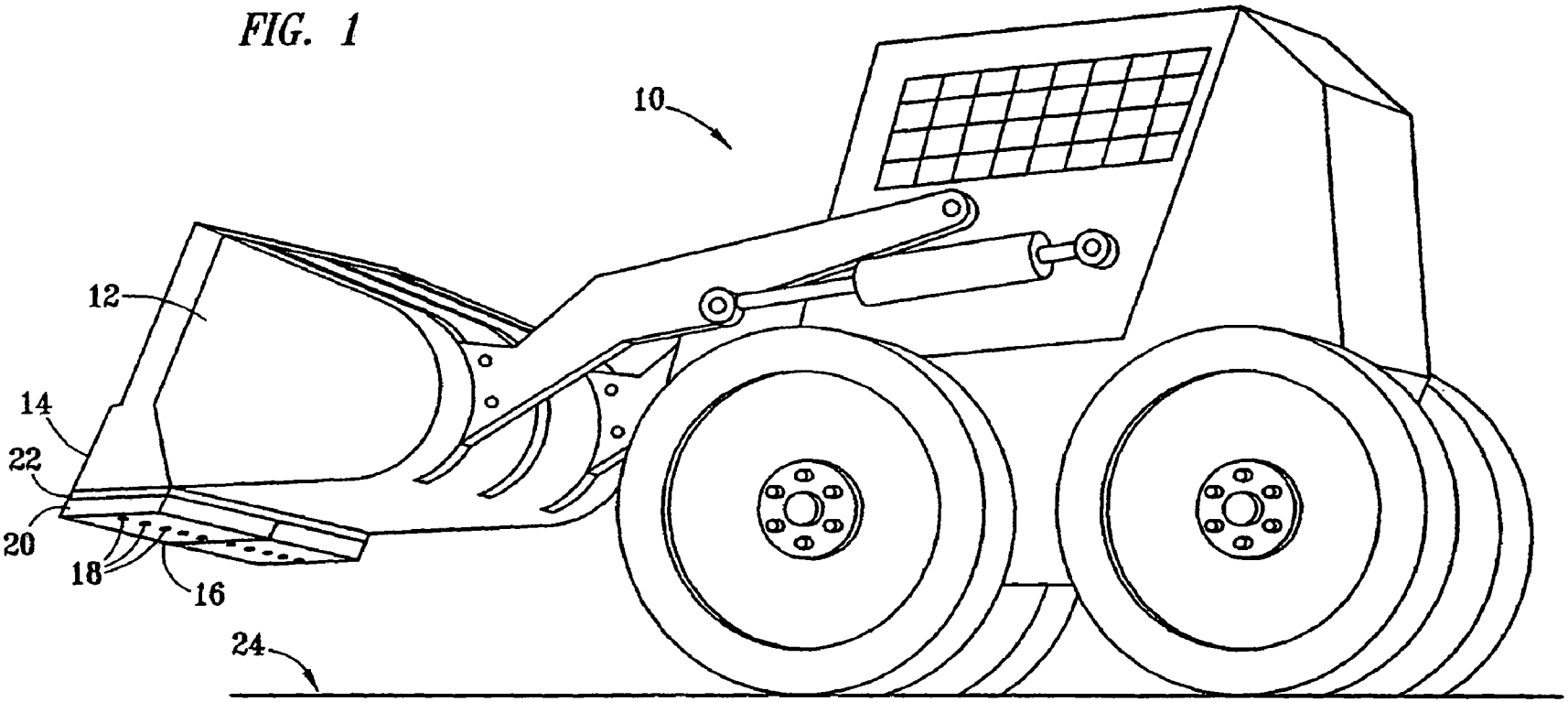
FIG. 1 is a perspective view of a squeegee blade shown attached to a front end loader.

Referring to FIG. 1, a piece of heavy equipment 10 is shown having a bucket 12 with a lower blade 14 to which a blade 16 with a rubber cutting edge is secured with fasteners through a plurality of attachment holes 18 in the lower blade 14 of the bucket 12. The rubber blade 16 comprises a rubber portion 20 and a mounting plate 22. It has been discovered that in use the rubber portion 20 can be placed under significant pressure and strain. The compressed rubber portion 20 can abrade quickly, particularly when it is moved under pressure across a concrete floor, an asphalt roadway, a paved surface or another abrasive ground surface. Under such conditions, and when the rubber is strained, the rubber portion 20 of the blade is more likely to tear and rupture, so that the adverse abrasive effect of movement against a floor 24 or against another surface, is accelerated.

Thus, it has been discovered that under significant pressure, the compressed rubber of a rubber edged blade is abraded quickly. When the rubber is compressed and strained it is more likely to tear and rupture, thereby accelerating the adverse effect of the abrasion. The present invention provides a squeegee blade that has a rubber portion with embedded support members that act to limit the compressive forces and the strain placed on the rubber. Reducing the compression of the rubber portion reduces the effect of abrasion and improves the useful life while maintaining the function of rubber to floor contact, thereby providing a desirable squeegee blade.

Figures 2, 3, 4:
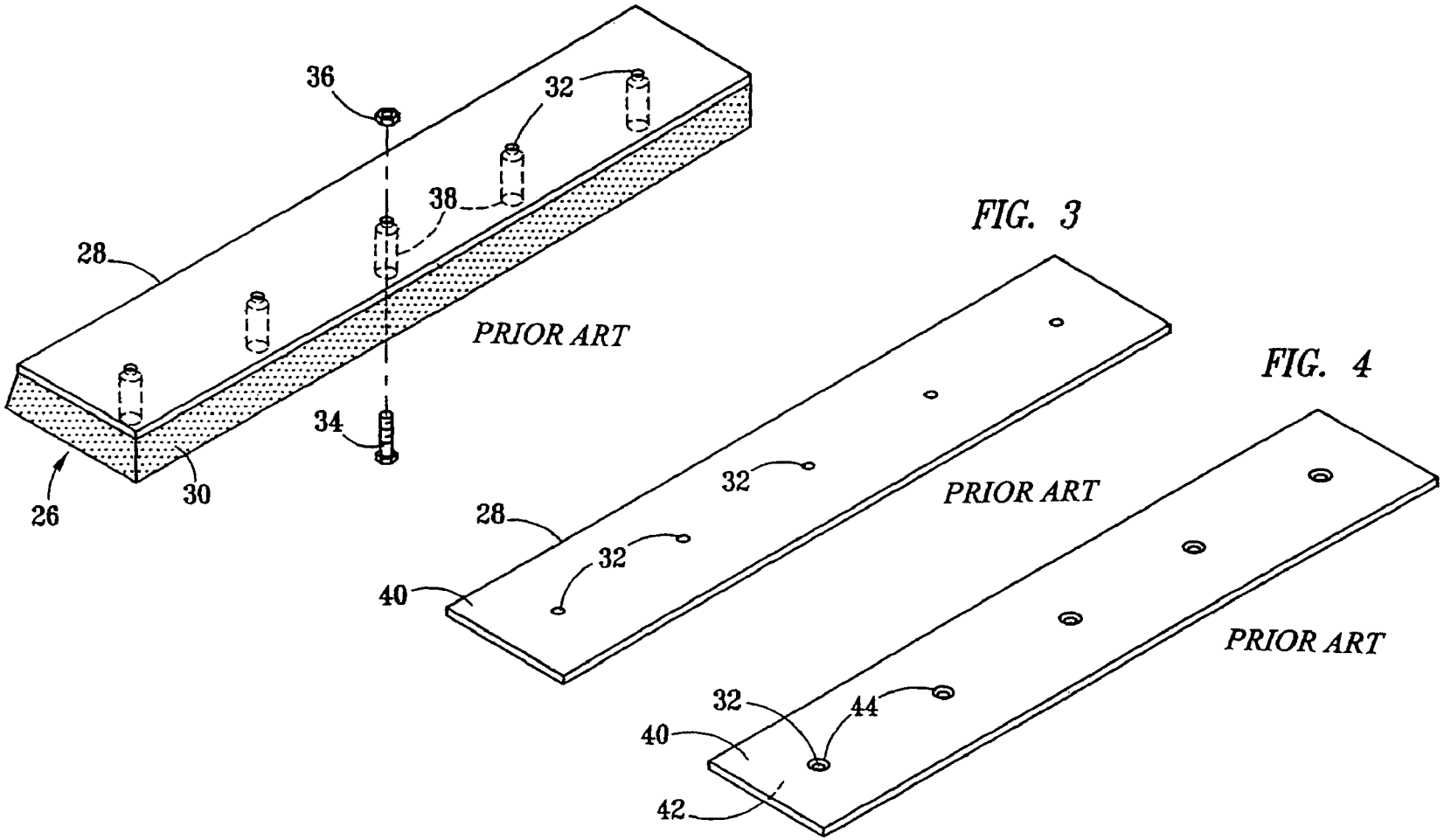
FIG. 2 PRIOR ART
FIG. 3 PRIOR ART
FIG. 4 PRIOR ART
FIG. 2 is a perspective view of a prior art squeegee blade.
FIG. 3 is a top perspective view of a prior art mounting plate to which rubber is adhered to form the prior art squeegee blade of FIG. 2.
FIG. 4 is a bottom perspective view of a prior art mounting plate of FIG. 3.

Referring to FIGS. 2, 3 and 4 a typical construction of a prior art rubber edged blade 26 is shown.

FIG. 2 shows a prior blade 26 that typically includes a metal mounting plate 28 and a rubber portion 30. The mounting plate 28 has a plurality of mounting holes 32 formed therein corresponding to the location of attachment holes 18 formed in the lower blade 14 of a bucket 12 attached to heavy construction equipment, such as a front end loader or similar. The locations of the mounting holes 32 must match closely to the locations of the attachment holes 18 for a particular blade 14 or piece of equipment 10. The rubber portion 30 is adhered to the mounting plate 28. The rubber portion 30 has bores 38 formed through the rubber at each mounting hole, to permit the fasteners 34, such a bolts 34, to be inserted and secure to the mounting plate 28, for example with threaded holes 18 in the blade 14 or with nuts 36 on the opposite side of the blade.

FIG. 3 shows a surface 40 of prior mounting plate 28 that abuts against the bucket blade 14.

FIG. 4 shows the prior bonding surface 42 to which the rubber portion 30 is adhered. The mounting holes may be provided with chamfers 44 to permit the bolts to firmly seat against the mounting plate.

Figures 5, 6, 7:
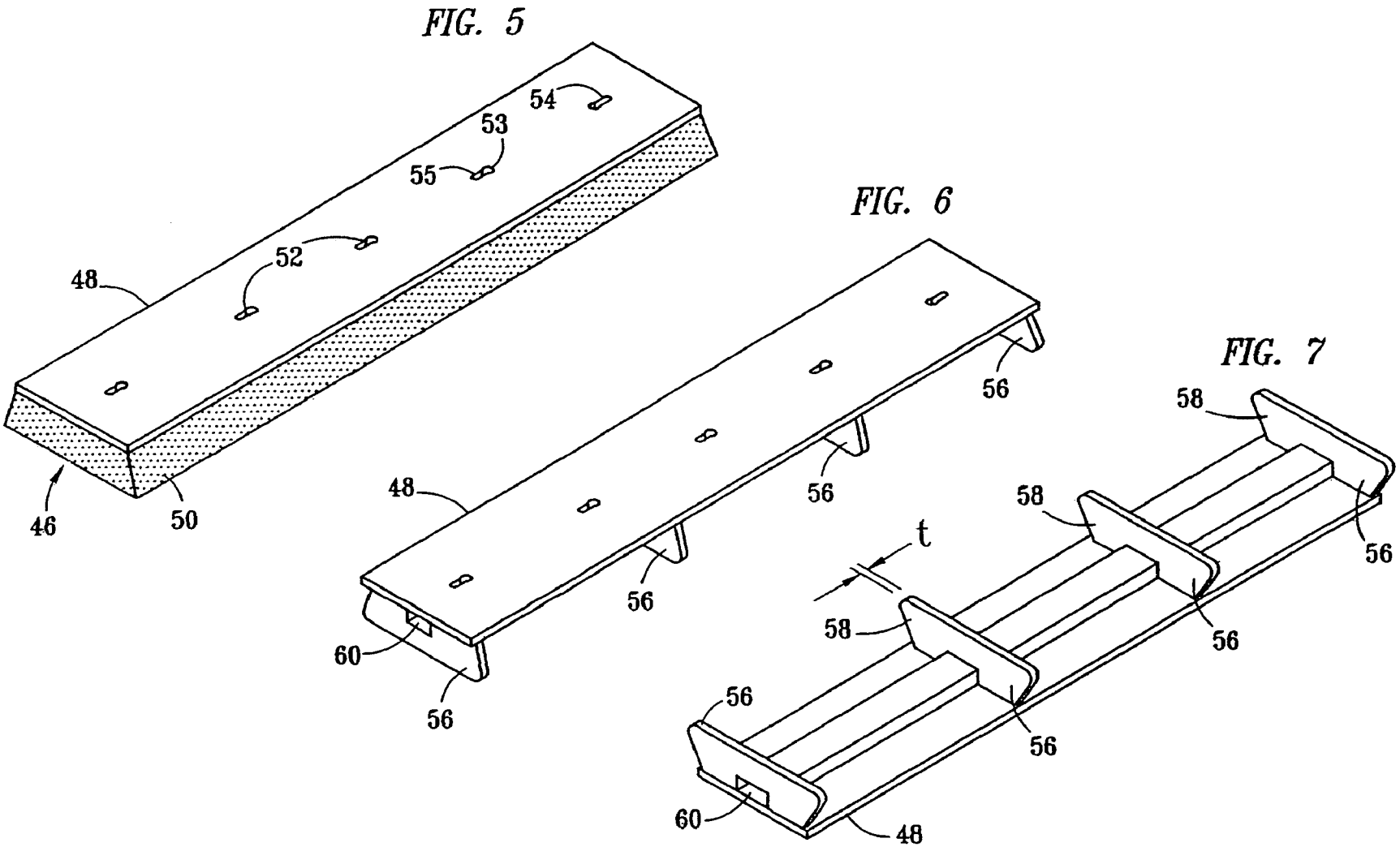
FIG. 5 is a perspective view of a squeegee blade according to an embodiment of the invention.
FIG. 6 is a top perspective view of a mounting plate to which rubber is molded to form the squeegee blade of FIG. 5.
FIG. 7 is a bottom perspective view of the mounting plate of FIG. 6.

Referring to FIGS. 5, 6, and 7, an embodiment of a squeegee blade 46 of the present invention is shown having a mounting plate 48 and a rubber portion 50 adhered to the mounting plate 48. In this embodiment a plurality of mounting holes 52 are formed on the mounting plate 48. To facilitate ease of assembly and alignment of the squeegee blade 46 on existing attachment holes 18 in the blade 14, the mounting holes 52 are formed as keyhole shaped openings, including a narrow slot or channel portion 55 sized for receiving a shaft of a fastener and for engaging a head of the fastener at one end of the channel portion a wide portion is formed sized for receiving therethrough the head of the fastener 34. The heads of bolts or fasteners 34 may be inserted through a large open portion 53 of the keyhole shaped mounting holes 52. With all of the bolts 34 in place, the heads of the bolts 34 may be slid along a narrow channel portion 55 into alignment with the existing holes 18. The aligned bolts are engaged in the holes 18, for example threaded into the holes 18 or secured with a nut 36, and the squeegee blade 46 is secured by tightening the bolts. Potential difficulties from minor mismatching of the locations of the mounting holes 52 with existing attachment holes 18 are thus reduced or avoided, thereby accommodating a wider variety of types of existing buckets 12, blades 14 and equipment 10. Allowing a larger range of tolerances also reduces the cost of manufacture.

In one alternative embodiment at least one of the mounting holes 52 is formed with a keyhole shape that is reversed in direction, as by rotating it 180 degrees, from the other mounting holes 52. This facilitates keeping the squeegee blade 46 held onto the equipment 10, even when minor loosening of the bolts might occur during use. An example of a reverse direction keyhole shaped mounting hole is shown at reference number 54. No matter which lateral direction the squeegee blade 46 might slip along the narrow portions 55 of the keyhole openings 52, the head of the bolt 34 engaged in the reverse direction key hole 54 will be prevented the other bolts 34 from reaching the wide opening portions 53. In this embodiment, when a squeegee blade 46 slips due to partially loosened bolts 34, the squeegee blade 46 can be re-tightened before it falls completely free from the equipment 10.

FIG. 6 shows the mounting plate 48, viewed from the top, before the rubber portion 50 is molded or otherwise adhered to it. In this embodiment, at least one support member, such as at least one runner 56 is attached to mounting plate 48. In the embodiment depicted, a plurality of runners 56 are attached to the mounting plate 48. The rubber portion 50 is formed interposed around the runners 56 and adhered to the mounting plate 48 and to the runners. In an exemplary embodiment, the at least one runner 56 is formed of metal. In one embodiment, the mounting plate 48 is made of metal, such as steel, and each runner 56 is formed of a plate or a bar of a similar type of metal so that it is conveniently secured to the mounting plate 48 by welding. The runners 56 have a height that is initially about the same or slightly shorter than the desired thickness of the rubber portion 50. For example, a plurality of relatively rigid runners 56 formed of metal plates may be secured at right angles downward from the mounting plate and extending parallel to one another in the forward and reverse direction of the construction equipment. It has been found by applicants that several of such runners 56 formed of metal plates each about 1 inch to 2 inches (about 2.5 to 5 cm) thick and secured at right angles to the mounting plate 48 provide good support against downward forces and allow for sliding without damage in forward and reverse directions of the construction equipment. The rubber portion 50 is usefully molded and adhered, as by laying raw rubber between and around the runners with or without adhesive agents at the interfaces and subjecting the entire squeegee blade to heat and pressure in a vulcanization process to cure the raw rubber. In one embodiment the rubber portion 50 is between the runners and also sufficiently thick to also encapsulate the runners within the cured rubber.

When the squeegee blade 46 is in use, the rubber portion 50 will compress up against the bottom surfaces 58 of the runners 56 and then the runners 56 will support the pressure of the blade. Even when the rubber portion 50 wears away to the surfaces 58 of the runners 56, the rubber portion 50 will continue to make contact, or to be in sufficiently close proximity, with the floor or ground surface between the runners to provide a desired "squeegee" function for many types of materials. Note that the term squeegee as used herein is not limited to squeegee of liquid materials, but also includes granular or nodular materials. After the rubber is worn to the runners 56, relatively rigid material of the runners 56 generally wears only slowly, even when used on very abrasive surfaces. Support from the runners prevents large strains from being placed on the rubber portion 50 that remains between the runners 56. With the strain on the rubber reduced, the rate of wearing, tearing, abrasion, and other deterioration is reduced. Thus, the support from the runners 56 reduces the rate of wear of the rubber portion 50.

By reducing the rate of wear and abrasion using embedded runners 56 according the invention, rubber edged blades and squeegee blades can be made with less depth (top to bottom) without reducing their useful life. Such less deep blades can be beneficial for scraping ground and floor surfaces, and picking up materials, such as nodular and fine granular materials.

FIG. 7 shows the runners 56 from the bottom or the adhering side of the mounting plate 48. The runners 56 have a sufficient thickness "t" so that the pressure of the squeegee blade against the ground or floor at any one location along the squeegee blade 46 will not unduly gouge or scratch into a typical concrete floor or paved surface. For example, runners 56 having a thickness of 1" to 2" (2.5 to 5 cm) have been found to work for this purpose. Also, included is a bolt head guard, such as a bolt channel 60, which prevents the molded rubber from interfering with the heads of bolts 34 when securing the squeegee blade 46 to the existing blade 14. The runners 56, as described can be formed of metal or other relatively rigid, hard, abrasion resistant, incompressible material, that provides a squeegee blade with runners that act to limit the compressive forces and the strain placed on the rubber of the squeegee blade. By reducing the effect of abrasion, an extended useful life of the squeegee blade is obtained.

Figure 8:
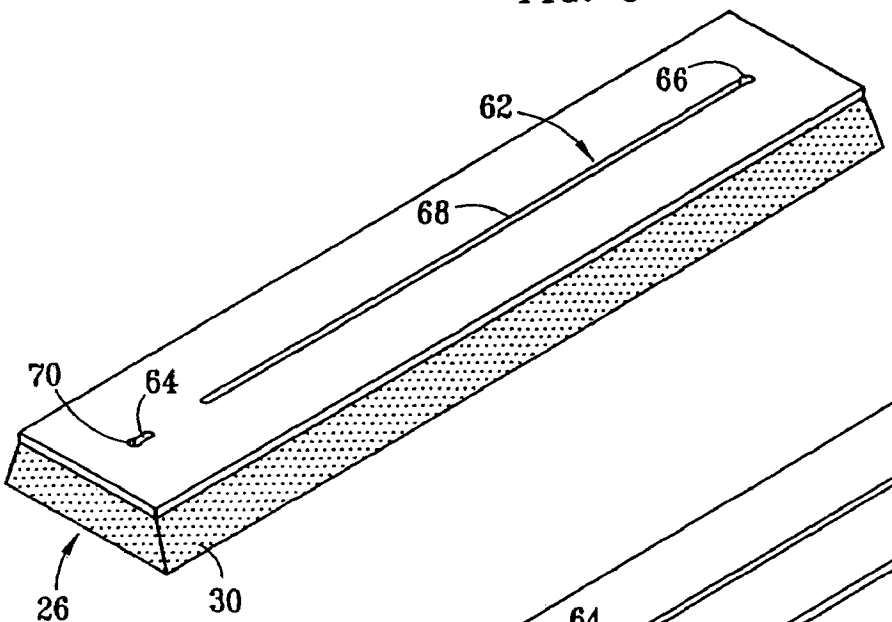
FIG. 8 is a perspective view of a squeegee blade according. to another embodiment of an example aspect of the present invention.
Figure 9:
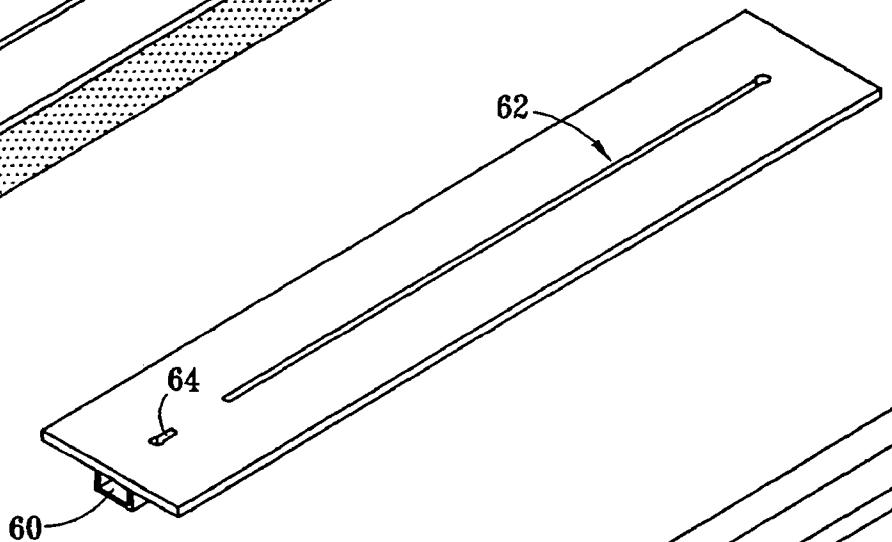
FIG. 9 is a top perspective view of a mounting plate to which rubber is molded to form the squeegee blade of FIG. 5 according to an example aspect of the invention.
Figure 10:
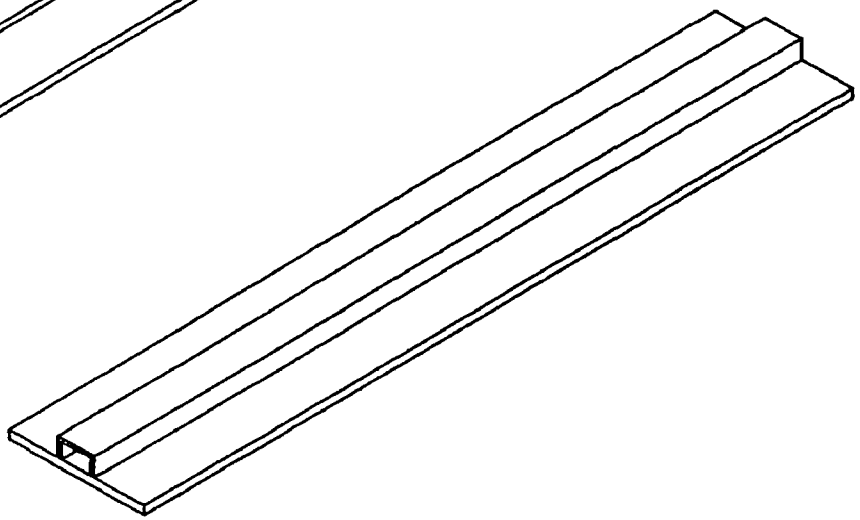
FIG. 10 is a bottom perspective view of the mounting plate of FIG. 9

In FIGS. 8, 9 and 10 an alternative embodiment of a squeegee blade is shown having an elongated mounting slot 62 having at least one wide opening 66 and an elongated slot portion 68. In one example embodiment as shown, there is also at least one reverse direction keyhole opening 64 separated from the elongated slot 62 by a portion of blade 14. At least one of the bolts 34 is inserted into the at least one key hole opening 64 and the bolt is aligned with one of the attachment holes 18 in an existing blade 14. The heads of a plurality of other bolts 34 are inserted into the wide portion 66 of mounting slot 62 and the bolts 34 are moved along a narrow elongated slot 68 to positions as required for alignment with and mounting to several remaining attachment holes 18 in an existing blade 14. The wide opening 66 of the elongated slot 62 is therefore positioned in an opposed direction from an open portion 70 of keyhole opening 64. As long as the bolts do not disengage from the nuts or from the threaded holes in the existing blade 14, the squeegee blade 46 remains attached to the equipment. Thus, the rubber edge blade 46 is prevented from sliding off the heads of the bolts 34 even when the bolts 34 might work loose. Thus, the slotted mounting arrangement depicted can be used to accommodate a wide variety of exiting attachment holes 18 without the need to custom make each rubber edged blade.

Figures 11, 12, 13:
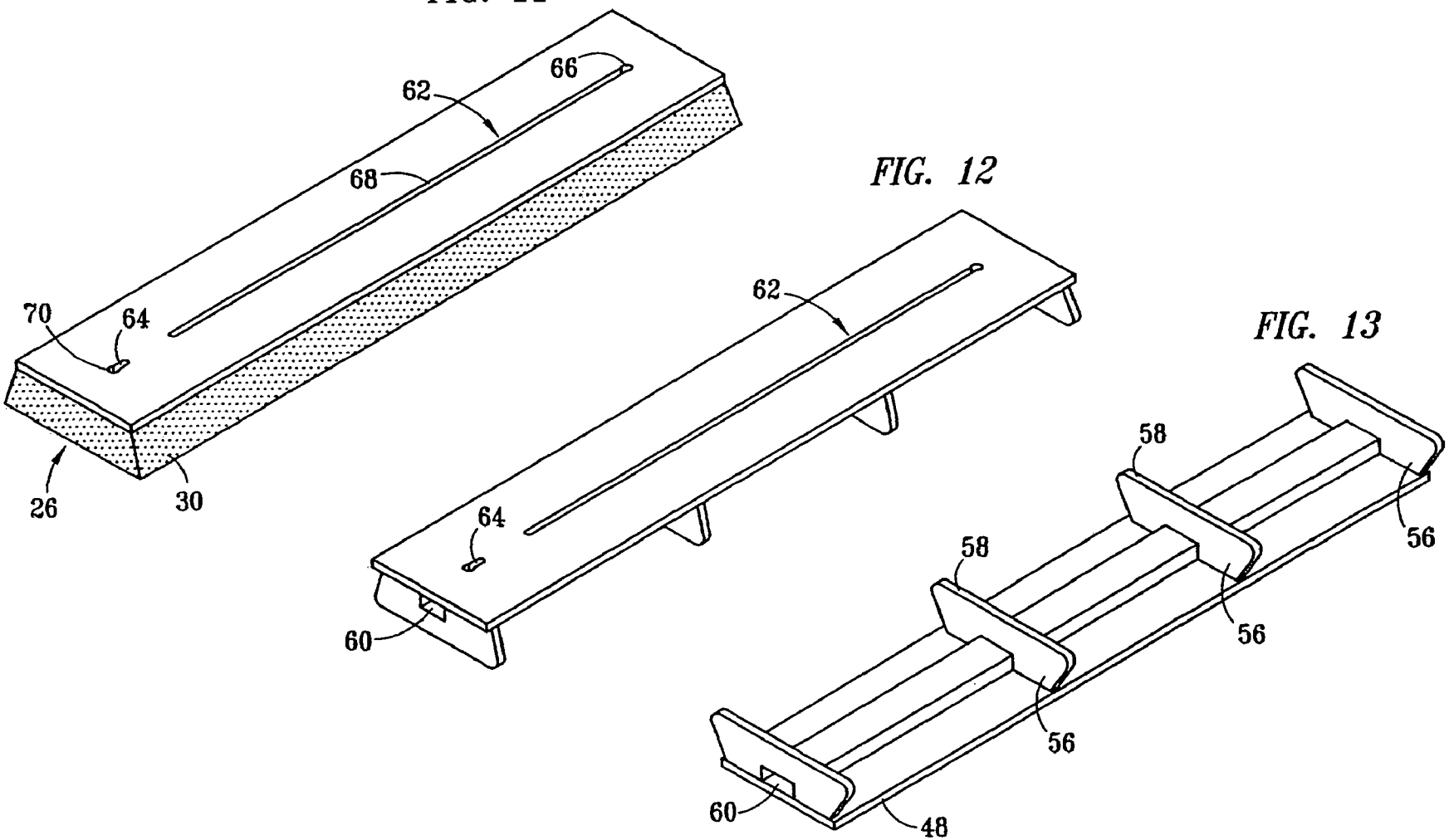
FIG. 11 is a perspective view of a squeegee blade according to another embodiment of and example aspect of the present invention.
FIG. 12 is a top perspective view of a mounting plate to which rubber is molded to form the squeegee blade of FIG. 11 according to an example aspect of the invention.
FIG. 13 is a bottom perspective view of the mounting plate of FIG. 12.

In FIGS. 11, 12, and 13 the elongated mounting slot and keyhole opening arrangement of FIGS. 8, 9 and 10 is applied to and can be combined with a squeegee blade having embedded metal runners according to other aspects of the present invention.

Variations and Equivalents

It is understood that variations may be made in the foregoing without departing from the scope of the invention. For example, terms with directional connotations such as top, bottom, upper, lower, outer, inner, side and end are used in context for purposes of relative positions and the device need not be limited to absolute directions in order to fall within the scope of the invention described and claimed. While various features and embodiments are described in certain combinations and sub-combinations, selected features from one embodiment may be combined with features of other embodiments without departing from certain aspects of the invention.

Although only a few example embodiments of this invention have been described in detail above, those skilled in the art will readily appreciate that many other modifications and variations are possible in these and other embodiments without materially departing from the novel teachings and advantages of this invention. Accordingly, all such modifications are intended to be included within the scope of this invention as claimed and for which applicants may be entitled to patent protection.

What is claimed is:

1. A squeegee blade comprising:

a mounting plate having an upper surface and a lower surface;

a plurality of support members forming a plurality of metal runners attached to the lower surface of the mounting plate generally parallel to each other and to the direction of forward and reverse movement of the squeegee blade and spaced apart from one another laterally across the lower surface of the mounting plate and having a height;

a flexible continuous vulcanized rubber blades, having a top and a bottom defining a depth, attached at the top to the lower surface of the mounting plate and encapsulating the plurality of runners and adhered to the plurality of runners and the lower surface of the plate, wherein the encapsulated plurality of runners provide vertical support against compression between the top and the bottom to the flexible continuous vulcanized rubber blade.

2. The squeegee blade according to claim 1, wherein the height of the plurality of runners is approximately equal to yet sufficiently smaller than the depth of the flexible continuous vulcanized rubber blade, so that the flexible blade encapsulates the plurality of runners and the plurality of runners support downward force on the squeegee blade to reduce compression of the flexible blade.

3. The squeegee blade according to claim 1, wherein the plurality of runners are perpendicular to the mounting surface.

4. The squeegee blade according to claim 1, wherein the mounting plate comprises metal.

5. The squeegee blade according to claim 1, wherein the plurality of runners comprise metal.

6. The squeegee blade according to claim 1, wherein the plurality of runners have a shape that corresponds to a cross section of the flexible blade.

7. The squeegee blade according to claim 1, wherein the flexible blade comprises a vulcanized rubber interface between the mounting surface and the flexible blade wherein the flexible blade is adhered to the mounting surface.

8. The squeegee blade according to claim 1, wherein the mounting plate comprises at least one fastener.

9. The squeegee blade according to claim 8, wherein the lower surface of the mounting plate further comprises at least one bolt head guard.

10. The squeegee blade according to claim 9, wherein the at least one fastener comprises a plurality of bolts having bolt heads and the bolt head guard comprises a channel that extends over the bolt heads of the plurality of bolts.

11. A squeegee blade for use on construction equipment, the squeegee blade comprising;

a relatively rigid mounting surface;

a plurality of relatively rigid supports secured to the mounting surface; and a relatively flexible blade having a top and a bottom, the top secured to the mounting surface and the relatively flexible blade formed of vulcanized rubber encapsulating and adhered to at least one of the plurality of relatively rigid supports, wherein the at least one encapsulated relatively rigid support extends substantially from the mounting surface to the bottom of the relatively flexible blade so that the relatively rigid support acts to support the relatively flexible blade against compression toward the relatively rigid mounting surface.

12. The squeegee blade of claim 11, wherein the relatively rigid mounting surface comprises a metal material.

13. The squeegee blade of claim 11, wherein the relatively rigid mounting surface comprises a mounting plate having an upper surface and a lower surface with the plurality of relatively rigid supports secured to the lower surface.

14. The squeegee blade of claim 13, wherein the at least one encapsulated relatively rigid support comprises at least one metal runner secured to the lower surface of the mounting plate and encapsulated by the vulcanized rubber of the flexible blade.

15. The squeegee blade of claim 13, wherein the mounting plate is comprised of a metal material and the relatively rigid support comprises at least one metal runner, wherein the at least one metal runner is comprised of a metal similar to the metal material of the mounting plate and wherein a metal weld joint is secured to the lower surface of the mounting plate and the at least one metal runner.

16. The squeegee blade of claim 14, wherein the mounting plate comprises a metal plate having a lower surfaces and the plurality of relatively rigid supports comprise a plurality of metal runners secured to the lower surface of the mounting plate generally parallel to each other and to the direction of forward and reverse movement of the squeegee blade and spaced apart from one another laterally across the lower surface of the mounting plate.

17. The squeegee blade of claim 16, comprising a plurality of metal weld joints connected along the plurality of metal runners and connected to the mounting plate such that the metal runners are secured thereby to the mounting plate.

* * * * *